US006668697B2

(12) United States Patent
Yu Chen

(10) Patent No.: US 6,668,697 B2
(45) Date of Patent: Dec. 30, 2003

(54) AUTOMATIC CUTTING DEVICE FOR AN ADHESIVE-TAPE HOLDER

(76) Inventor: Hsiu-Man Yu Chen, No. 27, Sec. 1, Dafu Rd., Tantz Shiang, Taichung (TW), 427

( * ) Notice: Subject to any disclaimer, the term of this patent is extended or adjusted under 35 U.S.C. 154(b) by 39 days.

(21) Appl. No.: 10/058,758

(22) Filed: Jan. 30, 2002

(65) Prior Publication Data

US 2003/0141337 A1 Jul. 31, 2003

(51) Int. Cl.[7] ..... B26D 7/00; B26F 3/00; B65H 35/00; B23B 31/00

(52) U.S. Cl. ..... 83/649; 225/19; 225/66; 225/89; 156/523; 156/579; 156/574; 156/577

(58) Field of Search ..... 83/649; 225/89, 225/56, 65, 66, 25, 20, 77, 19; 156/527, 579, 523, 574, 576, 577, 526; 7/158; 206/225, 228, 229; 242/422.5, 588

(56) References Cited

U.S. PATENT DOCUMENTS 3,753,839 A * 8/1973 Funke et al. ..... 156/577
5,236,540 A * 8/1993 Shi ..... 156/523
5,393,367 A * 2/1995 Yu Chen ..... 156/523
5,456,790 A * 10/1995 Yu Chen ..... 156/527
5,849,144 A * 12/1998 Tang et al. ..... 156/577
5,954,916 A * 9/1999 Orlandi ..... 156/386

* cited by examiner

*Primary Examiner*—Boyer D. Ashley
(74) *Attorney, Agent, or Firm*—Troxell Law Office PLLC

(57) ABSTRACT

An automatic cutting device for an adhesive-tape holder includes a handle, a blade holder, a blade and a press plate. The blade holder is provided with two fixing studs and a receiving groove. The blade has two oval holes fitted around the fixing studs of the blade holder. The blade slide base is mounted on the blade to activate the blade to move forward, and provided with two oval holes, a projecting stud and a spring. The press plate is formed with a push plate at the lower end for pushing the blade slide base. The blade is sandwiched between the blade slide base and the blade holder to be guided and restricted in shifting, so that it can automatically cut off an adhesive tape with precision when the press plate is pressed.

2 Claims, 4 Drawing Sheets

AUTOMATIC CUTTING DEVICE FOR AN ADHESIVE-TAPE HOLDER

BACKGROUND OF THE INVENTION

This invention relates to an automatic cutting device for an adhesive-tape holder, particularly to one having a blade sandwiched by a blade slide base and a blade holder and actuated to cut off an adhesive tape with precision when a press plate is pressed.

A conventional adhesive-tape holder, as disclosed in the Taiwan Patent No. 5641377, 5906705, 5849144, titled "RETRACTABLE BLADE HAND HELD TAPE APPLICATORS", has its flat plate and its blade connected by a spring and then pressed by a press plate having positioning member serving as a fulcrum to push the blade forward to cut off adhesive tape.

However, the spring in the foresaid conventional device is provided dangling between the flat plate and the blade, therefore it is likely to be contracted to an unexpected position and hard to recover its position as anticipated.

In addition, a fixing plate has to be additionally provided on the rear side of the press plate and positioning members have to be respectively provided on opposite sides of the fixing plate to be respectively inserted in the positioning grooves of an adhesive-tape holder and of a side plate to make up two pivotal shafts, thus complicating its structure and increasing its cost.

SUMMARY OF THE INVENTION

This invention has been devised to offer an automatic cutting device for an adhesive-tape holder, having a blade sandwiched by a blade slide base and a blade holder to be guided and restricted to move forward to cut off an adhesive tape precisely when a press plate is pressed.

BRIEF DESCRIPTION OF DRAWINGS

This invention will be better understood by referring to the accompany drawings, wherein.

DETAILED DESCRIPTION OF THE PREFERRED EMBODIMENT

Figure 1:
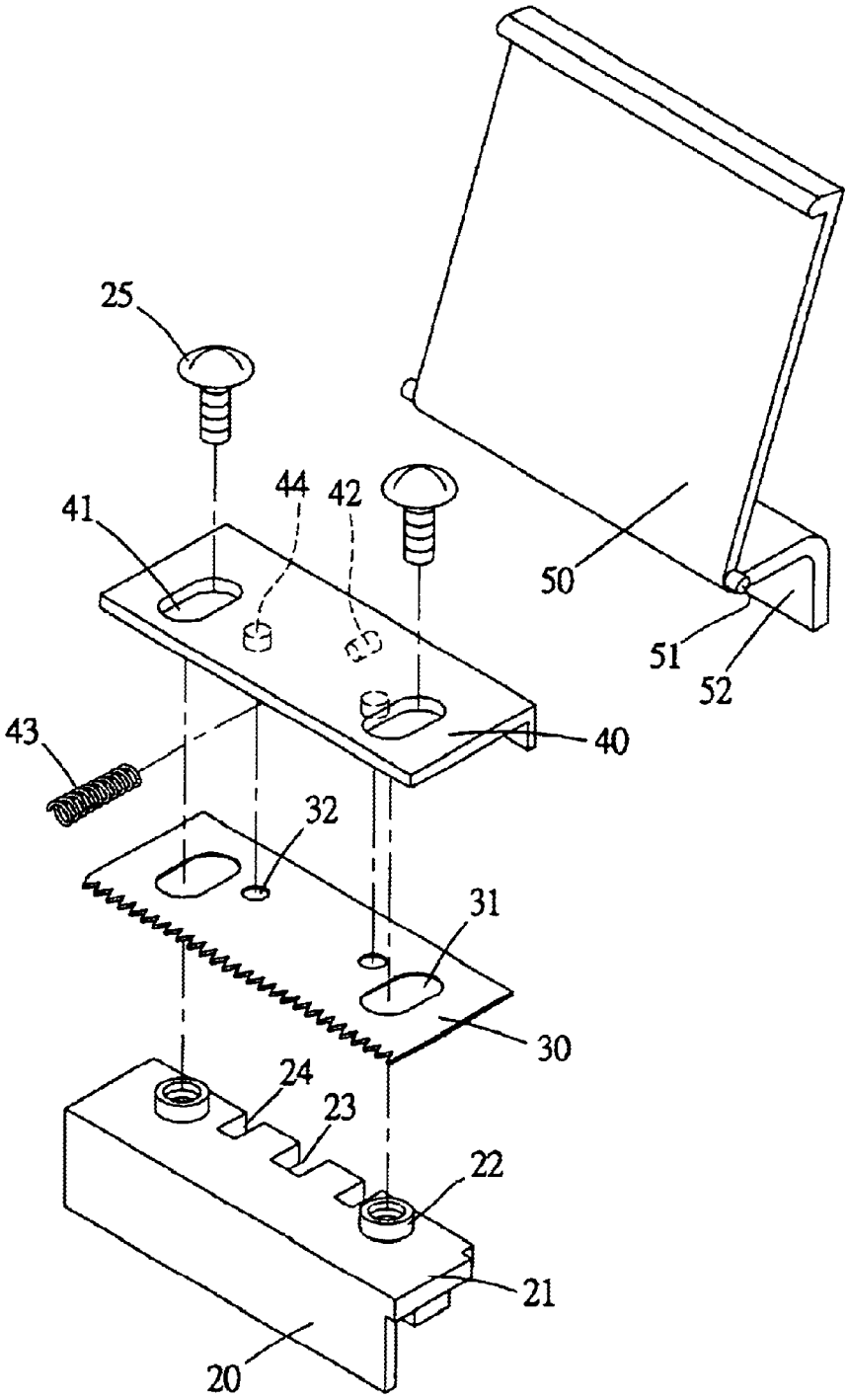
FIG. 1 is an exploded perspective view of an automatic cutting device for an adhesive-tape holder in the present invention.
Figure 2:
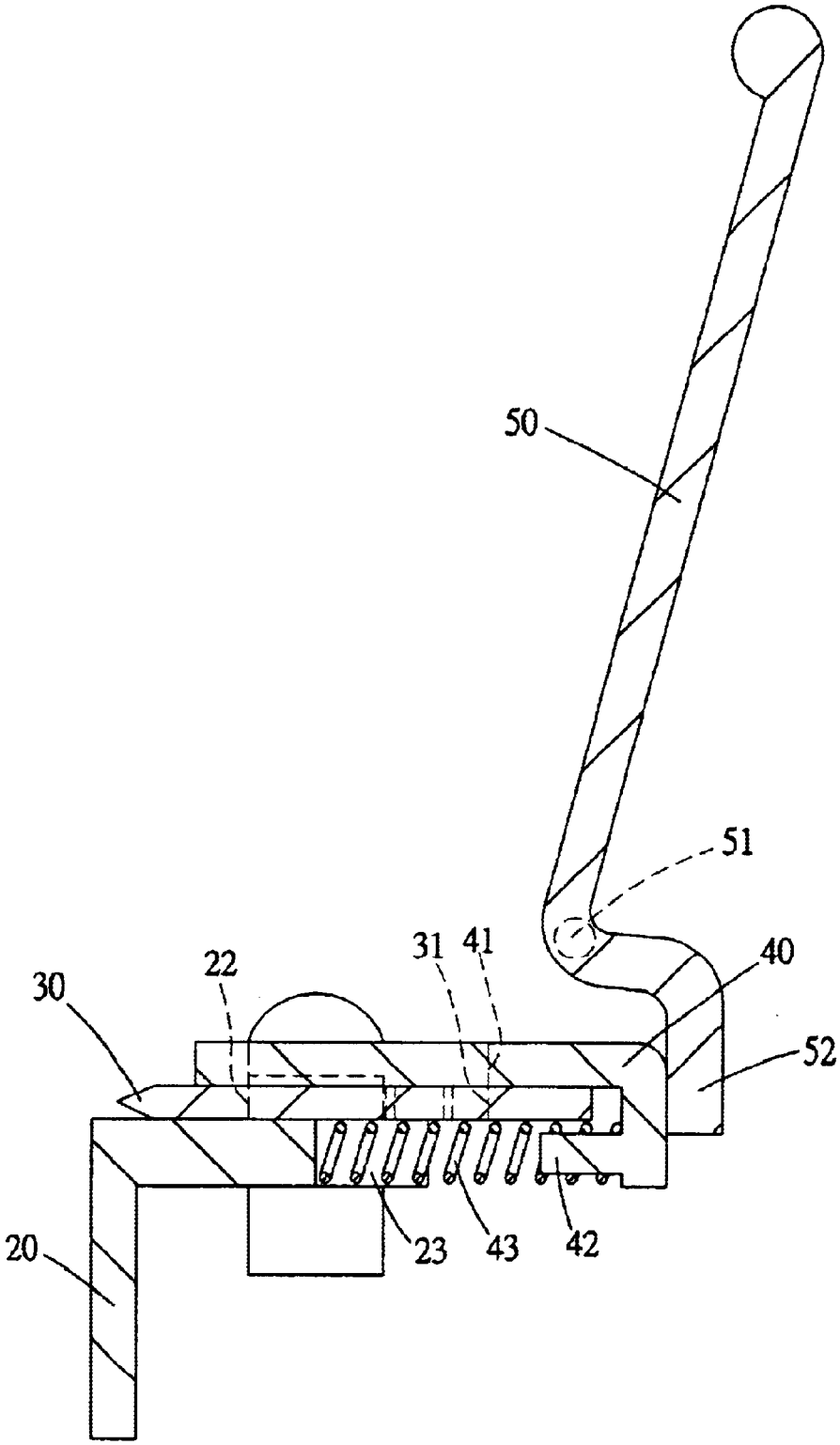
FIG. 2 is a side cross-sectional view of the automatic cutting device for an adhesive-tape holder in the present invention.

A preferred embodiment of an automatic cutting device for an adhesive-tape holder in the present invention, as shown in FIGS. 1 and 2, includes a blade holder 20, a blade 30, a blade slide base 40 and a press plate 50 as main components combined together.

The blade holder 20 is L-shaped and has its left side formed integral with a side plate 11 while its right side end formed with a fixing member 21. The fixing member 21 is directly inserted in the inner side edge of the side plate 12 of a handle 10. The blade holder 20 is provided on top with two fixing studs 22 protruding upward and respectively having a female thread for receiving a bolt 25. Further, a receiving groove 23 is formed between two fixing studs 22, and a slide groove 24 is respectively provided at the left and the right of the receiving groove 23.

The blade 30 is mounted on the blade holder 20 and provided with two oval holes 31 corresponding to and for receiving two fixing studs 22 of the blade holder 20. The blade 30 further has two position holes 32 to match with two slide grooves 24 of the blade holder 20.

The blade slide base 40 is L-shaped, fitted on the blade 30 to activate the blade 30 to shift. The blade slide base 40 is provided on top with two oval holes 41 conforming to the oval holes 31 of the blade 30, and a projecting stud 42 and a spring 43 on the inner wall of the lateral side. The spring 43 has one end fitted around the projecting stud 42 and the other end inserted in the receiving groove 23 of the blade holder 20 so as to enable the blade slide base 40 recover by the resilient force of the spring 43. In addition, the blade slide base 40 is provided with two position studs 44 protruding downward and corresponding to the position holes 32 of the blade 30 to be inserted through the position holes 32, and then get and shift in the slide grooves 24 to shift therein.

The press plate 50 curved in a ㄣ shape, provided with a pivotal stud 51 at a corner of opposite sides to be axially pivoted at a proper position of the side plate 11. The press plate 50 has a push plate 52 formed on the lower end for pushing against the lateral side of the blade slide base 40.

Figure 3:
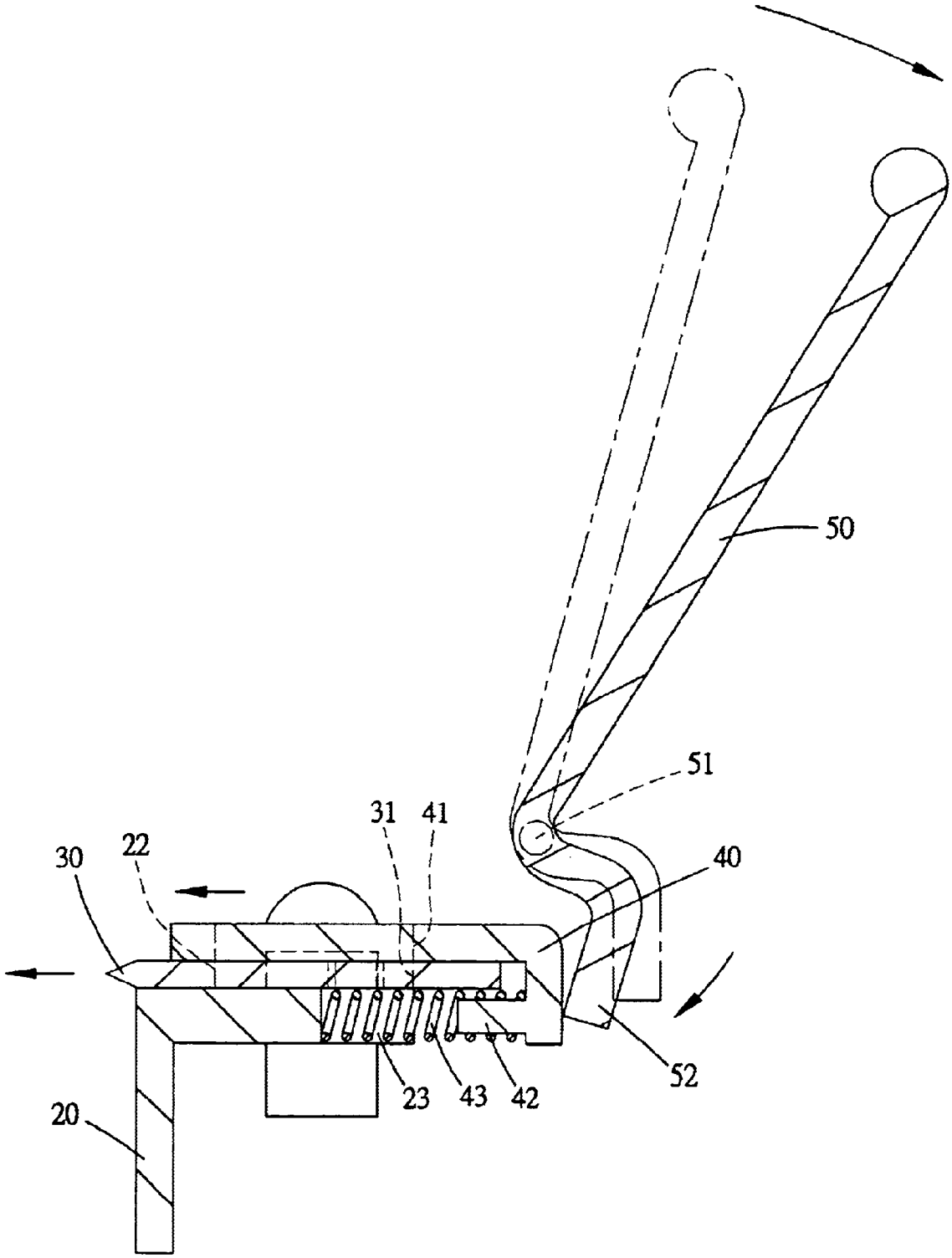
FIG. 3 is a side cross-sectional view of the automatic cutting device for an adhesive-tape holder in an operating condition in the present invention.
Figure 4:
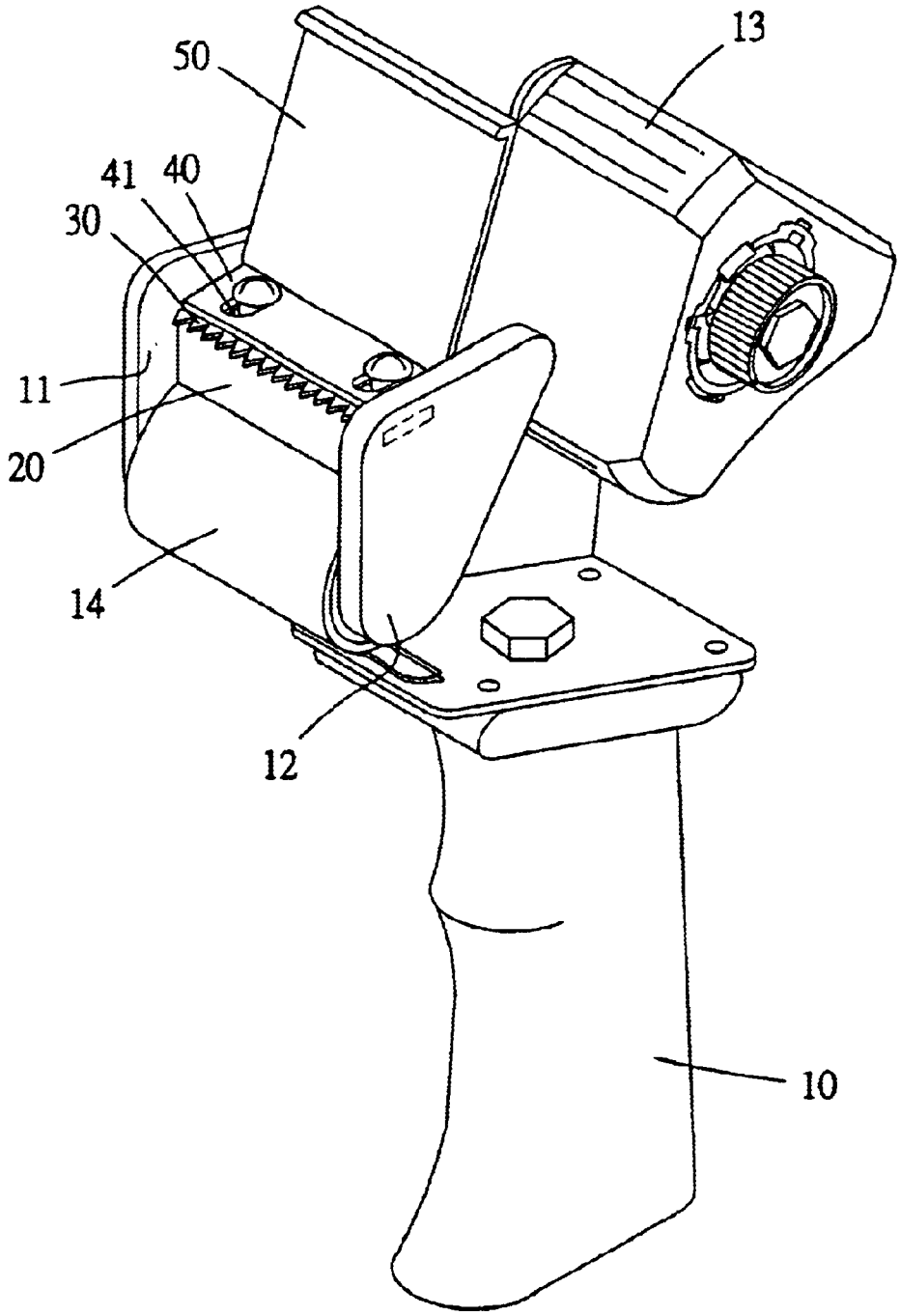
FIG. 4 is a perspective view of the automatic cutting device for an adhesive-tape holder in the present invention.

In assembling, as shown in FIGS. 2 and 3, firstly, the blade 30 is positioned on the blade holder 20, letting the oval holes 31 of the blade 30 fitted around the fixing studs 22 of the blade holder 20. Thus, the oval holes 31 are restricted to move back and forth along the fixing studs 22, and the blade 30 can only shift back and forth on the blade holder 20.

Next, the blade slide base 40 is mounted on the blade 30, letting the oval holes 41 fitted around the fixing studs 22 to be restricted to move to and fro therein, so that the blade 30 can simply shift back and forth along the fixing studs 22. At the same time, the position studs 44 are inserted through the position holes 32 and then get in the slide grooves 24 of the blade holder 20 to shift therein together with the blade 30. Then, fit one end of the spring 43 around the projecting stud 42 of the blade slide base 40 and insert the other end in the receiving groove 23 of the blade holder 20.

Subsequently, the press plate 50 is positioned on the rear side of the blade slide base 40, letting its push plate 52 push against the lateral side of the blade slide base 40, and lastly the whole device is sandwiched between the side plates 11 and 12 and secured by means of the fixing member 21 of the blade holder 20, with the press plate 50 capable to sway with the pivotal studs 51.

In using, an adhesive-tape roll is fitted on the adhesive-tape base 13 and the adhesive tape is pulled out to pass through a roller 14 and get onto the press plate 50. Then, hold the handle 10 to let the adhesive tape glued on the article to be adhered and pulled out by rotating the roller 14 with the adhesive tape flattened by the end edge of the press plate 50.

In case the adhesive tape is expected to be cut off, just forcefully press the handle 10 on the article being adhered to force the upper end of the press plate 50 sway backwards by leverage produced by the pivotal studs 51, and at the same time the push plate 52 is activated to push forward the blade slide base 40 together with the blade 30 as shown in FIGS. 2 and 3. Since the blade 30 is restricted to move back and forth along the fixing studs 22 inserting and moving in the oval holes 31, and sandwiched between the blade holder 20 and the blade slide base 40 to be guided and restricted in shifting, therefore the blade 30 can cut off adhesive tape on a level and with precision.

When the handle 10 is no longer pressed on the article, the blade slide base 40 together with the blade 30 and the press plate 50 will quickly recover their positions by the resilient force of the spring 43.

Evidently, this invention has some advantages described below.

1. The blade 30 is sandwiched between the blade holder 20 and the blade slide base 40 to be guided and restricted in shifting, therefore it can cut an adhesive tape on a level and with precision.
2. The press plate 50 is provided with pivotal studs on opposite sides as fulcrums, so one end of the press plate 50 can flatten the adhesive tape and the other end by leverage can push the blade 30 forward to cut off an adhesive tape.
3. When flattening the adhesive tape, the swaying force of the press plate 50 is smaller than the resilient force of the spring 43 so the blade 30 is impossible to protrude out, ensuring safety in using.
4. The blade 30 can automatically cut off an adhesive tape simply by pressing or releasing the handle 10, convenient in handling.

While the preferred embodiment of the invention has been described above, it will be recognized and understood that various modifications may be made therein and the appended claims are intended to cover all such modifications that may fall within the spirit and scope of the invention.

I claim:

1. An automatic cutting device for an adhesive-tape holder including a handle and two side plates and comprising:

a) an L-shaped blade holder connected between two side plates of a handle, the blade holder having:
   i) two fixing studs protruding upwardly; and
   ii) a center receiving groove;

b) a blade having two first oval slide holes, the fixing studs of the blade holder being inserted into the first oval slide holes of the blade;

c) an L-shaped blade slide base slidably connected to the blade holder, the blade slide base having:
   i) two second oval slide holes, the fixing studs of the blade holder being inserted into the second oval slide holes of the blade slide base;
   ii) a spring positioned between the center receiving groove in the blade holder and the blade slide base; and
   iii) a projecting stud inserted through the spring, wherein the blade slide base and blade are slidable between a retracted position and a cutting position; and d) an S-shaped press plate having two pivotal studs on opposing sides and a push plate on a first end thereof, each of the two pivotal studs pivotally connected to one of the two side plates, the push plate engaging the blade slide base, such that when a force is applied to the press plate on a second end opposite the push plate, the push plate compresses the spring and slides the blade slide base and blade into the cutting position, and when the force is removed from the press plate, the spring slides the blade slide base and blade into the retracted position.

2. The automatic cutting device for an adhesive-tape holder according to claim 1, further comprising:

a) two slide groves formed in the blade holder, one slide groove formed on either side of the receiving groove;

b) two positioning holes formed in the blade; and c) two positioning studs connected to the blade slide base and projecting downwardly, the two positioning studs inserted through the positioning holes of the blade and into the two slide grooves in the blade holder.

* * * * *